United States Patent [19]

Stecklow

[11] 4,136,981

[45] * Jan. 30, 1979

[54] LOOSE LEAF BINDER WITH FLEXIBLE TELESCOPIC POST ASSEMBLIES AND MAGNETICALLY RETAINED BAR

[76] Inventor: James P. Stecklow, 8558 Broadview Rd., Broadview Heights, Ohio 44147

[ * ] Notice: The portion of the term of this patent subsequent to Dec. 12, 1995, has been disclaimed.

[21] Appl. No.: 792,035

[22] Filed: Apr. 28, 1977

[51] Int. Cl.[2] ..... B42F 3/00; B42F 13/30; B42F 13/12

[52] U.S. Cl. ..... 402/46; 402/48; 402/57; 402/68; 402/503

[58] Field of Search ..... 402/46, 48, 49, 57, 402/60, 62, 68, 74–77, DIG. 503

[56] References Cited

U.S. PATENT DOCUMENTS

| | | | |
|---|---|---|---|
| 753,216 | 2/1904 | Hulquist | 402/48 |
| 1,044,753 | 11/1912 | Cooley | 402/48 |
| 1,437,329 | 11/1922 | Wilburger | 402/60 X |
| 1,452,860 | 4/1923 | Wilburger | 402/57 X |
| 2,285,525 | 6/1942 | Lotter | 402/48 X |

*Primary Examiner*—Robert Louis Spruill
*Attorney, Agent, or Firm*—Clarence A. O'Brien; Harvey B. Jacobson

[57] ABSTRACT

A loose leaf binder having a supporting base or lower cover member and a top cover member interconnected by post assemblies receiving a plurality of paper sheets together with a bar mounted on the post assemblies for longitudinal movement thereon with the bar being retained in adjusted position by magnetic attraction between the bar and post assemblies. Each of the post assemblies are constructed of a rigid member and a flexible member which are telescopically arranged and constructed to enable angular orientation of the telescoping components of the post assemblies.

8 Claims, 6 Drawing Figures

LOOSE LEAF BINDER WITH FLEXIBLE TELESCOPIC POST ASSEMBLIES AND MAGNETICALLY RETAINED BAR

BACKGROUND OF THE INVENTION

1. Field of the Invention

The present invention generally relates to loose leaf binders and more particularly that type of binder having telescopic post assemblies receiving loose leaf sheets of paper, brochures, and the like, together with a retaining bar movably mounted on the post assmblies for retaining the sheets of paper in position thereon with the retaining bar being retained in place by magnetic attraction at any point along the length of the post assemblies.

2. Description of the Prior Art

Loose leaf binders having rigid posts interconnecting the two covers or a base and a hold-down bar or cover are well known with the posts receiving and retaining loose leaf sheets of paper, brochures, and the like, Various mechanical devices have been provided for varying the length of the post assemblies and various mechanical arrangements have been provided for forcibly moving the hold-down bar towards the bottom cover or base for securely clamping the stack of sheets in place. Several loose leaf binder arrangements are disclosed in my prior U.S. Pat. No. 3,684,390, issued Aug. 15, 1972, and other hold-down arrangements are shown in the prior patents cited during prosecution of the application which matured into that patent. In addition, the following U.S. patents disclose various loose leaf binders at least some of which employ a magnetic feature incorporated therein.

911,125 — Feb. 2, 1909
1,019,174 — Mar. 5, 1912
1,380,694 — June 7, 1921
2,497,221 — Feb. 14, 1950
2,954,034 — Sep. 27, 1960
3,008,470 — Nov. 14, 1961
3,358,693 — Dec. 19, 1967
670,646 — June 20, 1972
3,701,605 — Oct. 31, 1972

SUMMARY OF THE INVENTION

An object of the present invention is to provide a loose leaf binder incorporating a supporting base or bottom cover member and a top cover member interconnected by a plurality of post assemblies which receive and mount a stack of loose leaf papers in which each of the post assemblies is longitudinally telescopic and includes a rigid tubular member and a flexible tubular spring member telescopic therein.

A further object of the invention is to provide a loose leaf binder in accordance with the preceding object together with a bar magnetically mounted on the post assemblies with the bar serving as a retainer. Pressure on the retainer or hold-down bar can be applied or relieved by manually moving the bar against or away from the stack of loose leaf papers whether the top cover is opened or closed with the bar being retained in a stationary position by magnetic attraction between the bar and the post assemblies.

A still further object of the invention is to provide a loose leaf binder in accordance with the preceding objects in which the bar is provided with a permanent magnet assembly at each post assembly and each post assembly has its full length capable of being attracted by the magnets in the bar for retaining the bar in any adjusted position along the length of the post assemblies in a manner to prevent complete free movement of the stacked loose leaf paper but enabling movement of the bar along the length of the post assemblies when manual pressure is exerted thereon when opening the loose leaf binder so that some of the loose leaves will extend in one direction and some of the loose leaves will extend in the opposite direction thus facilitating observation of the loose leaves in the area adjacent the post assemblies. When removing a brochure or individual paper, the top cover is opened thus exposing the stack of papers. The sheet to be removed is grasped with the thumb and first finger and pulled outwardly until the notched edge of the sheet separates from the post assemblies.

Yet another object of the invention is to provide a loose leaf binder which is relatively easy to construct, easy to adapt to various types of loose leaf binders and inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
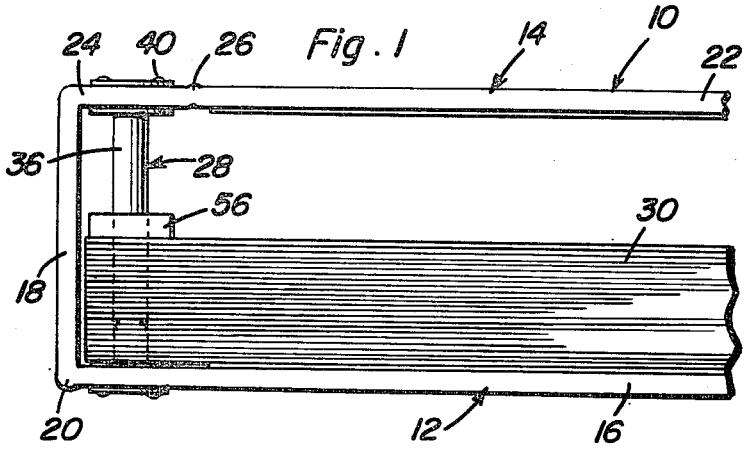
FIG. 1 is a partial end view of a loose leaf binder illustrating the association of components when the binder is in closed position.
Figure 6:
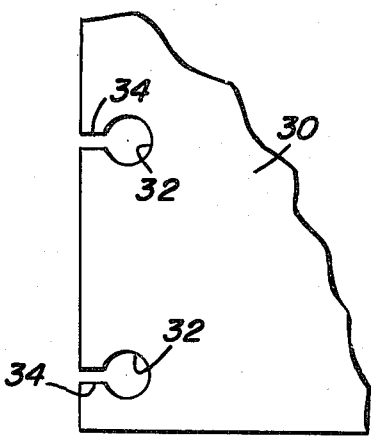
FIG. 6 is a fragmental plan view of a corner of one of the sheets of material illustrating the hole and slot therein.

Referring now to the drawings, the binder illustrated therein is generally designated by reference numeral 10 and includes a supporting base 12 and a top cover 14. The supporting base 12 is in the form of an enlarged rigid panel 16 extending all of the way to a spine member 18 and connected thereto by a hinge 20. The top panel 14 includes a top cover panel 22 and a top member 24 rigid with the spine 18 and perpendicular with respect thereto and joined to the top cover panel 22 by a hinge 26 so that when the binder 10 is opened, the spine 18 will rest against the same supporting surface as the bottom panel 16 and the short top member 24 will be rigidly upstanding and support the top cover panel 22 in a downwardly inclined position as in FIG. 2.

A plurality of post assemblies 28 extend between the supporting base 12 and the top cover 14 and receive and mount a plurality of loose leaf sheets or brochures 30 thereon with each loose leaf sheet 30 or brochure including apertures 32 with slots 34 extending from the aperture 32 to the adjacent end edge of the sheet 30 with the shape of the aperture 32 corresponding with the shape of the post assemblies 28 and it is pointed out that this shape and configuration may be varied as desired.

Figure 3:
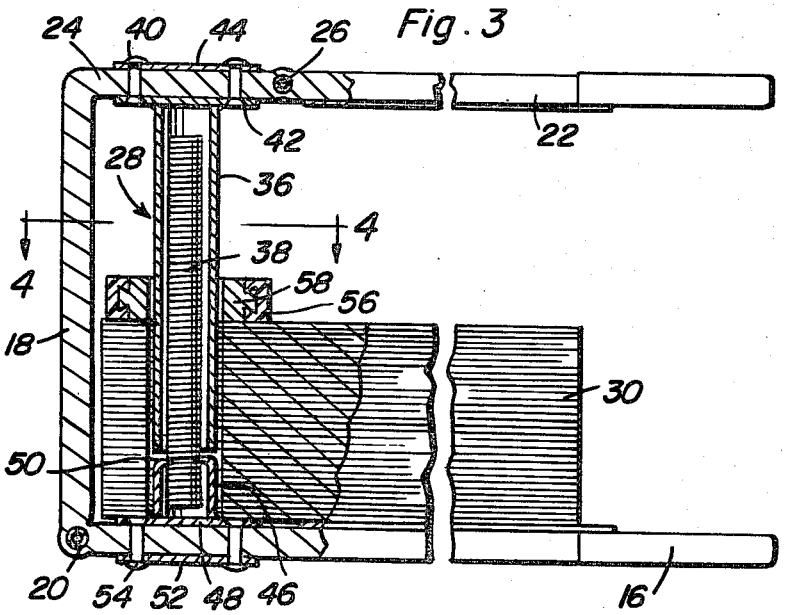
FIG. 3 is a vertical sectional view, on an enlarged scale, through one of the post assemblies illustrating the orientation of the components of the post assembly and the retaining bar.
Figure 4:
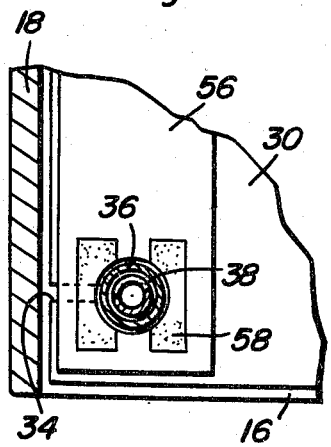
FIG. 4 is a transverse, sectional view taken substantially upon a plane passing along section line 4—4 of FIG. 3 illustrating further structural details of the post assembly and retaining bar.
Figure 5:
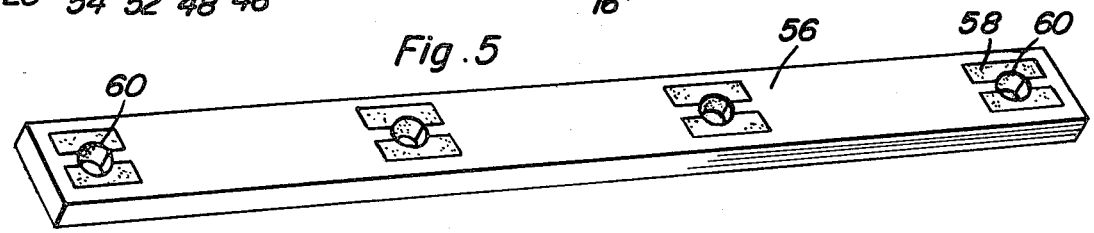
FIG. 5 is a perspective view of the retaining bar employed in this embodiment of the invention.

Each post assembly 28 includes an upper tubular rigid post 36 and a flexible lower post 38 in the form of a coil spring having the convolutions thereof normally in adjacent or contacting relation to each other and having an external dimension just slightly less than the internal dimension of the upper tubular post 36 for telescopic reception therein as illustrated in FIG. 3.

The upper tubular post 36 is secured to the top member 24 by rivets 40 which extend through a plate or washer 40 on the outer end of the tubular post 36. A plate or washer 44 is oriented between the top member 24 and the upper ends of the rivets 40 thus locking the upper post 36 to the top member 24.

Figure 2:
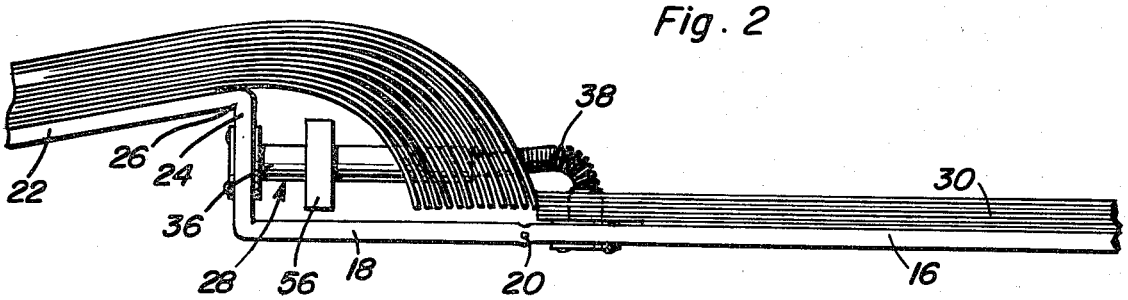
FIG. 2 is a partial end view of the binder of FIG. 1 illustrating the orientation of the components when the binder is in opened position.

The bottom end of the lower flexible post 38 is secured to the base member 16 by a hollow sleeve 46 having a washer or plate 48 at the outer end engaging the inner surface of the supporting base 16 and having its inner end telescopically receiving the lower end of the lower post 38. The inner end of sleeve 46 is crimped inwardly at 50 to secure the sleeve 46 to the post 38. A plate or washer 52 is positioned against the outer surface of panel 16 and rivets 54 extend through the plates 48 and 52 and panel 16. The lower tubular post 38 which is in the form of a coil spring is thus securely locked to the supporting base 16 and as illustrated in FIG. 3, the lower end of the upper tubular post 36 terminates slightly above the crimped upper end 50 of the hollow sleeve 46. With this construction, when the binder is opened as shown in FIG. 2, the upper tubular post 36 will move to a horizontal position and the coil spring or lower post 38 will move partially out of the tubular post 36 and flex into a smoothly curved arcuate position from the upper end of the sleeve 46, as illustrated in FIG. 2.

Mounted on the post assemblies 28 for longitudinal movement thereon is an elongated, relatively narrow, rectangular bar 56 of plastic material, or the like, having a plurality of permanent magnets 58 disposed in spaced relation along the length of the bar with the magnets 58 being embedded therein or otherwise secured thereto. Centrally of each pair of magnets, a hole 60 is provided through the bar which hole is of the same shape and size as the upper post 36 for longitudinal sliding movement thereon with the post 36 being subject to magnetic attraction so that the permanent magnets 58 will retain the bar 56 in adjusted position thereon with the bar being movable along the posts 36 by forces exerted thereon such as by the sheets or brochures 30 flexing in an arcuate manner to lie against the top cover panel 22 when the loose leaf binder 10 is opened to the position illustrated in FIG. 2 thereby enabling the loose leaves or brochures 30 to be properly positioned for observation. The free upper end of the coil spring 38 does not pull out of the tubular post 36 but will slide into and out of the post 36 during normal opening and closing of the binder. The retaining bar 56 will be retained in position due to the magnetic attraction between the magnets 58 and the ferrous construction of the tubular post 36 and the coil spring 38 with it being pointed out that either of these elements may be of non-metallic construction if desired or of any other construction with at least one of these elements being subject to magnetic attraction. Magnets may be provided at each hole 60 or only at the two end holes 60, if desired. The magnets may be arranged so that a portion of the periphery of the holes which receive the post assemblies will frictionally engage the post assembly due to a resultant lateral force exerted by the magnets.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A loose leaf binder for loose leaf sheets or brochures and enabling individual sheets or brochures to be removed or added without taking the binder apart and without removing additional sheets or brochures, said binder comprising a base member, a top member spaced from the base member and adapted to receive a plurality of loose sheets of material therebetween, a plurality of post assemblies extending between the base member and top member and receiving and mounting the loose leaves, each post assembly including a pair of tubular members with one of the tubular members extending from the base member and the other of the tubular members extending from the top member, the inner ends of the tubular members forming a telescopic relation with each other to enable variation in the length of each post assembly, wherein at least the tubular member forming the outer porton of said telescopic relationship has a rigid portion as a part thereof and at least one of said tubular members has a flexible portion as a part thereof, and including a paper hold down means which adheres to and is adjustable in relation to a rigid portion of at least one of said plurality of post assemblies for applying sufficient pressure to said sheets to hold them in the binder.

2. A loose leaf binder for loose leaf sheets or brochures and enabling individual sheets or brochures to be removed or added without taking the binder apart and without removing additional sheets or brochures, said binder comprising a base member, a top member spaced from the base member and adapted to receive a plurality of loose sheets of material therebetween, a plurality of post assemblies extending between the base member and top member and receiving and mounting the loose leaves, each post assembly including a pair of tubular members with one of the tubular members extending from the base member and the other of the tubular members extending from the top member, the inner ends of the tubular members forming a telescopic relation with each other to enable variation in the length of each post assembly, wherein at least the tubular member forming the outer portion of said telescopic relationship has a rigid portion as a part thereof and at least one of said tubular members has a flexible portion as a part thereof, and a retaining bar longitudinally movably mounted on the post assemblies, said retaining bar including magnets thereon, each post assembly being constructed of materials subject to magnetic attraction whereby the retaining bar will be magnetically retained in adjusted position but movable along the post assemblies when manual pressure is exerted thereon.

3. The structure as defined in claim 2 together with a retaining bar longitudinally movably mounted on the post assemblies, said retaining bar including magnets thereon, each post assembly being constructed of materials subject to magnetic attraction whereby the retaining bar will be magnetically retained in adjusted position but movable along the post assemblies when manual pressure is exerted thereon.

4. The structure as defined in claim 3 wherein said base member and top member are interconnected by a spine, said spine being pivotally attached to the base and rigidly connected to the top member whereby pivotal movement of the top member and spine about the pivotal connection to the base causes the inner member of said telescopic relationship to move partially out of the outer tubular member of said telescopic relationship and causes said flexible portion to flex into a curved position as the binder is opened.

5. A loose leaf binder comprising a supporting base, a top member spaced from the base, a plurality of loose sheets of material therebetween, a plurality of post assemblies extending between the supporting base and top member and receiving and mounting the loose leaves, each post assembly including a pair of telescopic members, the inner ends of the telescopic members being disposed in overlapping relation to enable variation in the length of the post assembly without separation of the telescopic members, a retaining bar movably supported on the post assemblies in engagement with a stack of loose leaves, said retaining bar including magnetic means thereon, at least certain of said post assemblies being constructed of material subject to magnetic attraction whereby the retaining bar will be magnetically retained adjusted position but movable along the post assemblies when manual pressure is exerted thereon, said telescopic members being tubular with one of the tubular members being rigid and the other being in the form of a resilient flexible member having its free end telescoped into the rigid tubular member and being of a length to remain telescoped during movement of the binder to an open position and permitting flexing thereof into curved relation to the rigid tubular member.

6. The structure as defined in claim 5 wherein said resilient flexible member is in the form of a coil spring having closely adjacent convolutions.

7. The structure as defined in claim 6 wherein a portion of the top member is rigid with the rigid tubular member and rigid with the spine thus retaining the spine parallel to the rigid tubular member.

8. The structure as defined in claim 5 wherein said top member includes a hinged cover hingedly connected to the top member adjacent the post assemblies, a rigid spine perpendicular to and rigid with the top member enabling the cover to be pivoted to open position without moving the spine, said supporting base being rigid throughout its length, and hinge means connected to the lower end of the spine to the edge of the base member to enable the spine to pivot to a position in alignment with the base member when the top member is moved to vertical position and said rigid member moves toward horizontal position when the binder is opened.

* * * * *